US005079996A

United States Patent [19]

Abousabha et al.

[11] Patent Number: 5,079,996

[45] Date of Patent: Jan. 14, 1992

[54] POSITIVE DISPLACEMENT CONTROL FOR A VARIABLE DISPLACEMENT COMPRESSOR

[75] Inventors: Naji G. Abousabha, Youngstown; Robert L. Swadner, East Amherst, both of N.Y.

[73] Assignee: General Motors Corporation, Detroit, Mich.

[21] Appl. No.: 638,606

[22] Filed: Jan. 8, 1991

[51] Int. Cl.[5] ..... F01B 3/00; F01B 13/04

[52] U.S. Cl. ..... 92/12.2; 92/71; 417/222 C; 74/60

[58] Field of Search ..... 92/12.2, 57, 71; 417/269, 270, 222, 222 S; 91/506, 505; 74/60

[56] References Cited

U.S. PATENT DOCUMENTS

| | | | |
|---|---|---|---|
| 2,684,630 | 7/1954 | Widmer et al. | 417/222 R |
| 2,721,519 | 10/1955 | Henrichsen | 417/222 R |
| 2,955,475 | 10/1960 | Zubaty | 417/222 R |
| 2,964,234 | 12/1960 | Loomis, III . | |
| 3,143,973 | 8/1964 | Bubzich | 92/57 |
| 3,450,058 | 6/1969 | Stein | 92/71 |
| 4,077,269 | 3/1978 | Hodgkinson | 74/60 |
| 4,428,718 | 1/1984 | Skinner . | |

FOREIGN PATENT DOCUMENTS

| | | | |
|---|---|---|---|
| 547350 | 10/1957 | Canada | 417/222 |
| WO83/02131 | 6/1983 | PCT Int'l Appl. | 417/222 |

*Primary Examiner*—Edward K. Look
*Assistant Examiner*—Thomas Denion
*Attorney, Agent, or Firm*—Ronald L. Phillips

[57] ABSTRACT

A fluid pumping assembly including a housing and a plurality of pistons disposed parallel relative to one another and supported for reciprocal movement in the housing. The assembly also includes a shaft which is supported by the housing and which has a longitudinal axis. A wobble plate is mounted about the shaft. A drive mechanism is rotatably driven about the longitudinal axis of the shaft and drives the wobble plate through angulartory movement relative to the shaft thereby reciprocating the pistons. The shaft is nonrotatably supported in the housing but is precisely moveable coaxial of its longitudinal axis to predetermined points to adjust the position of the wobble plate thereby precisely varying the displacement of the assembly.

5 Claims, 2 Drawing Sheets

POSITIVE DISPLACEMENT CONTROL FOR A VARIABLE DISPLACEMENT COMPRESSOR

BACKGROUND OF THE INVENTION

1. Technical Field

The subject invention relates to a fluid pumping assembly of the type having a variable displacement capacity and more specifically to a wobble plate type pumping assembly wherein the position of the wobble plate within the housing and the angulartory movement of the wobble plate is positively controlled to precisely control the displacement of the pump.

2. Description Of The Prior Art

Wobble plate type pumping assemblies having variable displacement capabilities are well known in the prior art. In these types of pumping assemblies, the position of the wobble plate in the pump housing is adjusted to vary the displacement of the pump. Varying the displacement in wobble plate type pumps can be achieved in a number of ways. For example, U.S. Pat. No. 4,428,718 issued to Skinner on Jan. 31, 1984 discloses a compressor which employs a control valve to vary the displacement of the compressor. Control valves of this type are typically disposed in the discharge and suction chambers of the compressor and react to various pressure differentials to control the crank case pressure to increase or decrease the wobble plate angle relative to a drive shaft, thus varying the capacity of the compressor or pump.

Other examples can be found in pumps wherein the wobble plate is mounted about a centrally disposed rotating or driven shaft wherein the rotating shaft is adjustable within the pump housing to vary the displacement. Prior art disclosing such structure can be found in U.S. Pat. No. 4,433,596 issued to Scalzo on Feb. 28, 1984; U.S. Pat. No. 4,077,269 issued to Hodgkinson on Mar. 7, 1978 and U.S. Pat. No. 2,964,234 issued to Loomis III on Dec. 13, 1960.

However there are certain disadvantages which are inherent in the prior art. For example, pumps which employ control valves, such as the Skinner '718 patent noted above, are totally dependent upon compressor crank case pressure. As such, these types of compressors are not responsive to changes in other important parameters such as engine load or engine RPM.

Pump assemblies having wobble plates mounted about power driven rotating shafts which are also adjustable within the pump housing must employ complex structure in order to achieve the variable displacement feature. This results in an increase in the cost of manufacturing these pumps as well as the increase probabilities for failure of one of the multiple moving parts.

The prior art is further deficient in that the position of the wobble plate and thus the pump displacement cannot be precisely controlled. The displacement may be merely increased or decreased but not precisely controlled to a predetermined level. Furthermore, it is not possible in the prior art to precisely maintain the displacement of the pump over time. Accordingly, pumping assemblies, such as refrigerant compressors in automotive applications, which are driven via a power input through a pulley must also include a clutch assembly which is able to disengage the compressor when no output is required or during heavy engine loading.

SUMMARY OF THE INVENTION AND ADVANTAGES

The subject invention is directed toward a fluid pumping assembly including a housing and a plurality of pistons disposed parallel relative to one another and supported for reciprocal movement in the housing. A shaft is supported by the housing and has a longitudinal axis. A wobble plate is mounted about the shaft. A drive means is rotatably driven about the longitudinal axis of the shaft for driving the wobble plate through angulartory movement relative to the shaft thereby reciprocating the pistons. The subject invention is characterized by the shaft being nonrotatably supported in the housing but precisely moveable coaxial of the longitudinal axis to predetermined positions to adjust the position of the wobble plate and thereby precisely varying the displacement of the fluid pumping assembly.

The subject invention has the advantages in that it eliminates the need for expensive control valves for monitoring and reacting to pressure differentials between the crank case and the discharge chamber. Further, refrigerant compressor assemblies employing the subject invention in automotive applications can be made responsive to a number of parameters such as evaporator load, engine load, engine RPM etc. As such, and when the control valve is eliminated, the compressor crank case need not be controlled and isolated from the main refrigerant flow stream. When this deficiency is eliminated by the subject invention, the cool suction, or inlet, gas, which contains lubricant, can be directed through the crank case and around the compressor internal mechanism to cool and lubricate the same. This feature makes the compressor run cooler and thereby enhances compressor life.

Because the subject invention provides for precise, continuous control of the pump displacement, the need for a clutch is also eliminated. For example, in automotive applications when a compressor employing the subject invention is used in conjunction with an air conditioning system, when engine load increases or compressor output requirements approaches zero, the nonrotating shaft may be moved to a predetermined position such that the piston stroke is zero. This results in zero compressor displacement. In this way, the compressor load upon the engine is also minimized. Similarly when the situation requires maximum displacement or any fraction thereof, the nonrotating shaft is moved to and maintained at another predetermined position, which results in the designated pump displacement.

A further feature is that the position of the non-rotating shaft can be determined by counting the number of clockwise or counterclockwise revolutions of an electric motor driving a shaft position adjustment means. The position of the nonrotating shaft will indicate the amount of piston stroke and compressor load that will be placed on the vehicle engine. The position signal can be directed to an engine controller to adjust engine operation accordingly.

The subject invention overcomes the problems in the prior art in an efficient, fluid pumping assembly having positive and precise control of the pump displacement. The elimination of the need for control valves and clutches, as well as multiple moving parts by the subject invention, results in a cost effective advantage over the prior art.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION THE PREFERRED EMBODIMENT

Figure 1:
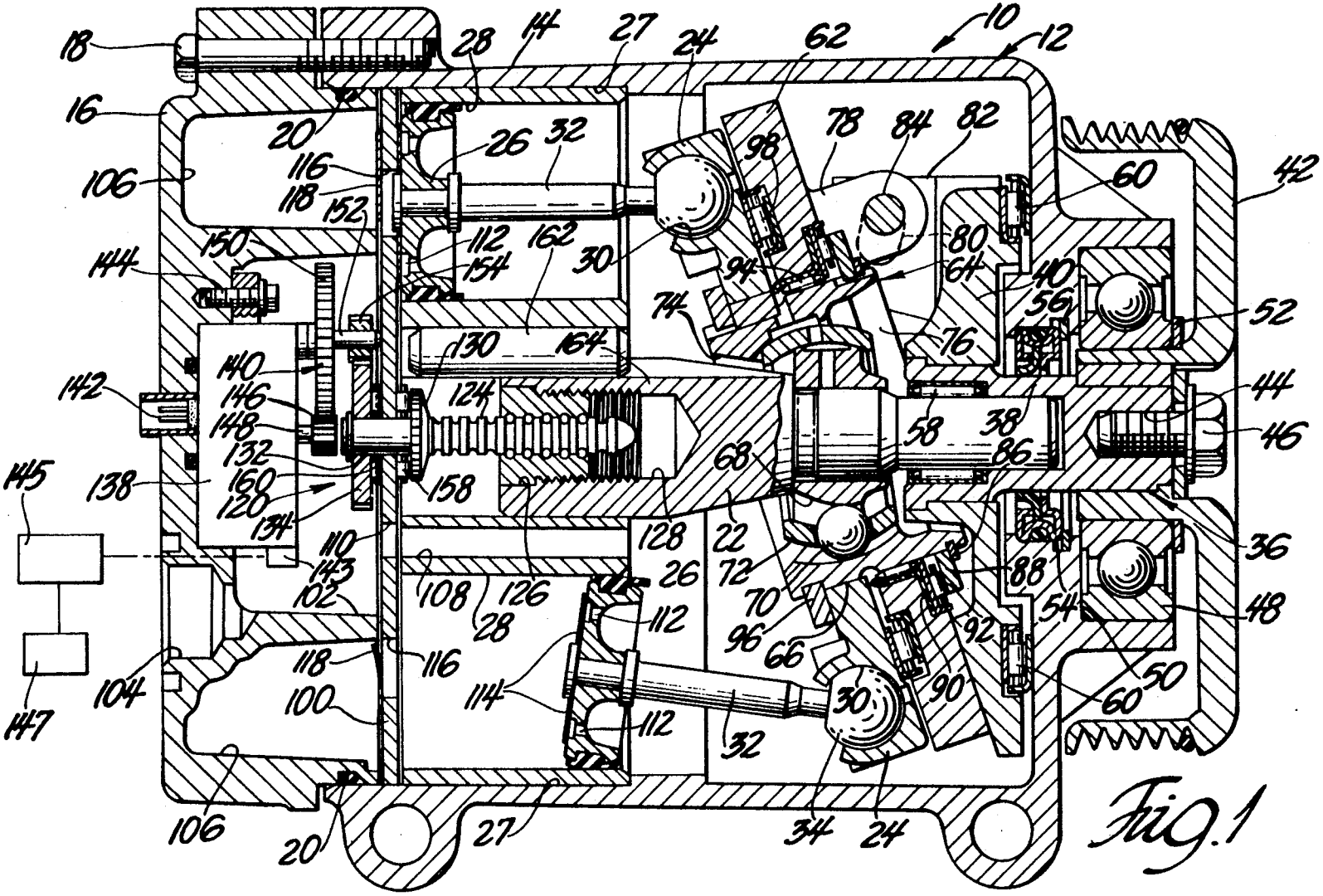
FIG. 1 is a cross sectional view of a fluid pumping assembly according to the subject invention illustrating the nonrotatable shaft disposed at a predetermined position such that the piston stroke and therefore pump displacement is at a maximum.
Figure 2:
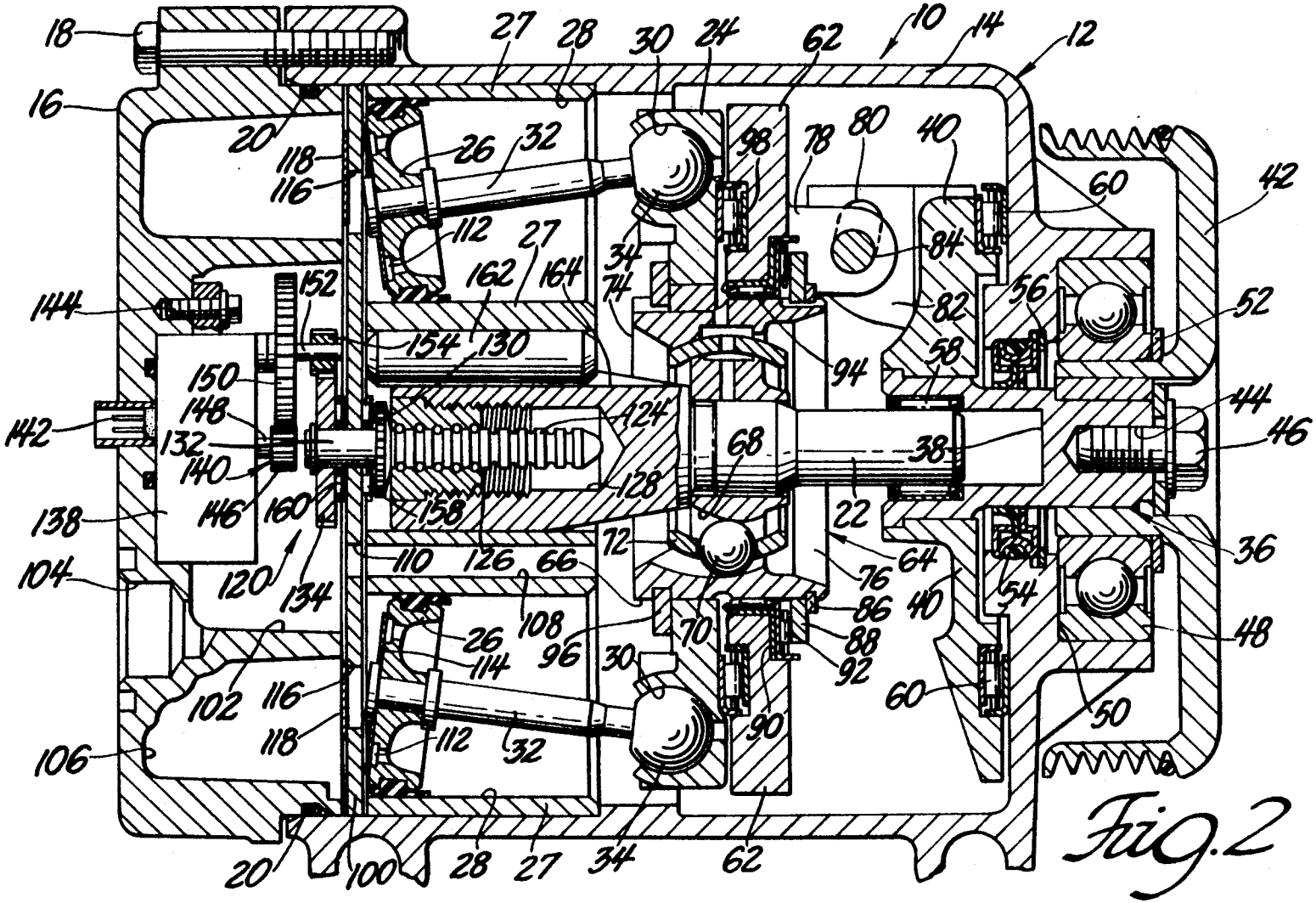
FIG. 2 is a cross Sectional view of the fluid pumping assembly according to the subject invention illustrating the nonrotatable shaft disposed at a predetermined position such that piston stroke and therefore pump displacement is at a minimum.

Referring to FIGS. 1 and 2, wherein like numerals indicate like corresponding parts throughout the two views, a fluid pumping assembly of the type having a variable displacement capacity is generally shown at 10 in FIGS. 1 and 2. For purposes of description only and not by way of limitation, the subject invention will be described with respect to a refrigerant compressor 10 of the type for compressing a recirculated refrigerant fluid in an automotive air conditioning system having the normal condenser for condensing a refrigerant gas into a liquid, an orifice tube, evaporator and accumulator arranged in that order (but not shown) between the compressor discharged and suction sides as is commonly known in the art.

The compressor 10 has a housing, generally indicated at 12, which includes a crank case 14 and head 16. The head 16 is sealingly clamped and fixedly attached to one end of the crank case 14 via fasteners 18 and O-ring 20.

The compressor assembly also includes a nonrotatable shaft 22 centrally supported in the crank case 14 of the housing 12. The shaft 22 has a longitudinal axis and will be described in greater detail below. A variable angle wobble plate 24 is mounted about the shaft 22. A plurality of pistons 26 are disposed parallel relative to one another and supported for reciprocal movement in the housing 12. More specifically, each of the pistons 26 is spaced in equal angular increments about the housing 12 at equal radial increments from the longitudinal axis of the nonrotating shaft 22. Each piston 2 is slideably reciprocal in axial cylinders 27 which define compression chambers 28. The wobble plate 24 includes a plurality of sockets 30 associated with each piston 26 and spaced in equal angular increments about the radial edge of the wobble plate 24. A piston rod 32 is connected to the backside of each piston 26 in known fashion and terminates in a ball 34. The ball 34 is received in the socket 30 and allowed for reciprocal movement of the piston 26 in the cylinder 27.

The assembly further includes a drive means, generally indicated at 36, and rotatably driven about the longitudinal axis of the nonrotating shaft 22 for driving the wobble plate 24 through angulartory movement relative to the shaft 22 and thereby reciprocating the pistons 26 in the cylinder 27. The drive means 36 includes a drive member 38 and a hub 40 which is fixedly attached to and driven with the drive member 38. The drive member 38 is driven by a pulley 42 which, in turn, is operatively driven by an automotive engine in the refrigerant compressor assembly 10 of the preferred embodiment. The drive member 38 includes a threaded bore 44 which is centrally disposed and adapted to receive a threaded fastener 46 or the like to operatively attach the driven pulley 42 to the drive means 36. Radial bearing 48 is received in an annular pocket 50 in the top of the housing 12 at the interface of the rotating pulley 42 and the housing 12. A snap ring 52 is employed for retaining the radial bearings 48 in the annular pocket 50. The crank case 14 through which the gaseous refrigerant is cycled is sealed from the atmosphere at the top of the housing with a teflon coated lip seal 54. A retaining ring 56 securely holds the lip seal 54 in place. Needle bearings 58 are employed at the interface of the drive member 38 and the nonrotating shaft 22 and radial thrust bearings 60 are used at the interface of the rotating hub 40 and the top of the crank case 14.

The compressor assembly 10 further includes a journal 62 which is axially retained relative to the shaft 22 on a constant velocity joint, generally indicated at 64, but rotatably driven by the hub 40 of the drive means 36. More specifically, the constant velocity joint 64 includes an outer race 66, an inner race 68 which is fixed to the nonrotating shaft 22 and a plurality of ball bearings 70 retained by a cage 72 disposed therebetween. The race 66 is nonrotatable but is capable of angulartory movement relative to the shaft 22. To this end, the outer race 66 includes conically diverging portions 74, 76 at either end for facilitating this motion relative to the shaft 22 at one end and the hub 40 at the other end, respectively.

The journal 62 includes an ear 78 extending away from the journal 62 and which carries a cross pin 84. The hub 40 includes a lug 82 which extends toward the ear 78 and which includes an arcuate guide slot 80. The cross pin 84 is carried in the guide slot 80 and adjustable therein according to the position of the wobble plate 24 in the housing and the relative angle of the wobble plate 24 relative to the shaft 22. For example, the cross pin 84 is disposed at one end of the guide slot 80 when the compressor displacement and piston stroke are at a maximum as shown in FIG. 1 and is held in the guide slot 80 at its other end when the compressor displacement and piston stroke is at a minimum as shown in FIG. 2. The interaction of the hub 40 and the driven journal 62 are like that disclosed in greater detail in U.S. Pat. Nos. 4,175,915 and 4,297,085, respectively assigned to the assignee of this invention and as commonly known in the art.

The journal 62 is axially retained on the constant velocity joint 64 relative to the shaft 22 by the combination of the retaining ring 86 and thrush washer 88. The journal 62 includes an annular stepped surface 90 near its inner diameter. An annular thrust bearing 92 is disposed between the thrust washer 88 and the stepped surface 90. Similarly, needle bearings 94 are disposed between the inner diameter of the journal 62 and the outer surface of the outer race 66 of the constant velocity joint 64.

Similarly, the wobble plate 24 is axially retained on the constant velocity joint 64 relative to the shaft 22 by a retaining ring 96 disposed opposite the journal retaining ring 86. An annular thrust bearing 98 is employed between the interface of the wobble plate 24 and the journal 62 to allow for the relative rotation of the journal 62 with respect to the wobble plate 24 while driving the wobble plate 24 through angulartory movement relative to the shaft 22. In this way, as the hub 40 of the drive means 36 rotatingly drives the journal 62, the nonrotatable wobble plate 24 is driven through angulatory movement relative to the shaft 22, thereby reciprocating the pistons 26 in the cylinder 27.

A valve plate 100 is fixedly clamped between the head 16 and the crank case 14. The head 16 includes an inlet chamber 102 for receiving gaseous refrigerant via an inlet port 104 from the accumulator and a discharge chamber 106 from which gaseous refrigerant is pumped to a condenser. An inlet passage 108 provides fluid communication between the inlet chamber 102 through an opening 110 in the valve plate 100 and the crank case 14.

Each piston 26 includes a plurality of passages 112 which provide fluid communication through one way flapper valves 114 between the crank case 14 and the compression chambers 28. Similarly, outlet passages 116 are provided in the valve plate 100 to provide fluid communication between the compression chambers 28 through one way flapper valves 118 or the like and the discharge chamber 106.

The compressor assembly 10 of the subject invention pumps gaseous refrigerant in the following manner. During the intake stroke of the piston 26, the refrigerant is drawn into the inlet chamber 102 through the port 104, through the opening 110 and inlet passage 108 up into the crank case 14. The refrigerant is further drawn through the piston passages 112 and into the compression chamber 28. During the compression stroke of the piston 26, the refrigerant is pumped out of the compression chamber 28 through the outlet passage 116, into the discharge chamber 106 and ultimately to the condenser.

According to the subject invention, the compressor assembly 10 includes a shaft 22 which is nonrotatably and centrally supported in the housing 12 but precisely moveable coaxial of the longitudinal axis to predetermined points to adjust the position of the wobble plate 24 thereby precisely varying the displacement of the compressor assembly 10. To this end, the assembly 10 includes shaft adjustment means, generally shown at 120, for precisely moving the nonrotatable shaft 22 coaxial of its longitudinal axis. The shaft adjustment means 120 includes a ball screw 124 rotatable relative to a nut 126 disposed in and threadably received by a bore 128 in one end of the shaft 22. Alternatively, the ball screw and nut may be replaced by a power screw or ACME screw which is rotatable relative to a threaded bore 128 disposed in one end of the shaft 22.

In any event, the screw 124 terminates in a head 130 and includes a mounting pin 132 which extends from the screw head 130 through an aperture in the valve plate 100 into the inlet chamber 102. The screw 124 further includes a gear 134 disposed remote from the nonrotating shaft 22 and mounted on the mounting pin 132 of the screw 124. The shaft adjustment means 120 further includes an electric motor 138 and a gear train, generally indicated at 140, disposed intermediate of the motor 138 and the screw mounted gear 134 for rotating the screw 124 to move the shaft 22 coaxial of its longitudinal axis. More specifically, the electric motor 138 and the gear train 140 are disposed within the inlet chamber 102. Electric motor 138 may be of any type but it has been found advantageous to employ a hermetically sealed stepper motor which is electronically controlled by a controller (not shown) via the connector 142 extending through an opening in the head 16. The electric motor 138 itself is anchored to the head 16 via a fastener 144 or the like. The revolutions of the electric motor can be sensed by a tachometer 143 which will produce a signal of each motor revolution either clockwise or counterclockwise. The signals are counted by a counter 145 to direct a signal to a vehicle engine controller 147 operative to adjust engine operation in accordance with changes in piston stroke (and compressor load resulting therefrom) which result as the motor 138 positions the nonrotating shaft 22 to change the angle of wobble plate 24.

The gear train 140 is a reverted gear train which includes a pinion 146 mounted to a powered shaft 148 of the motor 138. The pinion 146 operatively drives an input gear 150 which rotates a pin 152 upon which an output gear 154 is also mounted. The output gear 154 operatively drives the screw mounted gear 134 and thus the screw 124 itself. Thrust bearings 158 are employed between the underside of the screw head 130 and one side of the valve plate 100. Thrust bearings 160 are similarly employed between one side of the screw mounted gear 134 in the opposite side of the valve plate 100.

As alluded to above, the shaft 22 is centrally supported in the crank case 114 adjacent to and surrounded by the cylinders 24. The shaft adjustment means 120 further includes at least one key 162 fixedly disposed between a cylinder 27 and the shaft 22 and extending parallel to the longitudinal axis of the shaft 22. The shaft 22 includes a notch 164 which also extends parallel to the longitudinal axis of the shaft 22. The key 162 is in abutting and sliding contact with the longitudinal extending notch 164 of the shaft 22 to prevent rotation of the shaft 22 but allowing movement coaxial of the longitudinal axis of the shaft 22.

In accordance with the advantages of the subject invention, and in response to any signal pertaining to, for example, evaporator load, engine load, engine RPM etc. from a controller, the hermetically sealed electrical stepper motor 138 can be instructed to move the nonrotating shaft 22 through the interaction of the reverted gear train 140 and the gear 134 mounted to the screw 124 coaxial of its longitudinal axis to a precise and predetermined position between zero stroke as shown in FIG. 2 and maximum stroke as shown in FIG. 1. Equally as important, the shaft 22 may be constantly maintained at any predetermined point over an extended period of time without fear of unwanted adjustment.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

We claim:

1. A fluid pumping assembly, said assembly comprising;

a housing;

a plurality of pistons disposed parallel relative to one another and supported for reciprocal movement in said housing;

a non-rotatable shaft supported by said housing and having a longitudinal axis;

a wobble plate mounted about said shaft;

a drive means rotatably driven about said longitudinal axis of said shaft for driving said wobble plate through angulatory movement relative to said shaft thereby reciprocating said piston;

shaft adjustment means for precisely moving said non-rotatable shaft coaxial of said longitudinal axis to predetermined points to vary the position of said wobble plate thereby varying the displacement of said assembly;

said shaft adjustment means including a screw rotatable relative to a threaded bore disposed in one end of said shaft to move said shaft coaxial of said longitudinal axis;

said screw including a gear disposed remote from said shaft and mounted on said screw, said shaft adjustment means further including an electric motor and a gear train disposed intermediate of said motor and said screw mounted gear for rotating said screw to move said shaft coaxial of said longitudinal axis;

said assembly characterized by said housing including a crank case and a head fixedly attached thereto, said shaft centrally supported in said crank case adjacent a key, said shaft including a notch extending parallel to said longitudinal axis of said shaft, said key fixedly supported by said crank case and in abutting, sliding contact with said longitudinally extending notch of said shaft to prevent rotation thereof but allowing movement coaxial of said longitudinal axis of said shaft.

2. A fluid pumping assembly as set forth in claim 1 further characterized by said shaft adjustment means including a bass screw rotatable relative to a nut disposed in one end of said shaft to move said shaft coaxial of said longitudinal axis.

3. A fluid pumping assembly as set forth in claim 1 further characterized by said shaft adjustment means including a power screw rotatable relative to a threaded bore disposed in one end of said shaft to move said shaft coaxial of said longitudinal axis.

4. A fluid pumping assembly as set forth in claim 1 further characterized by said shaft adjustment means including an ACME screw rotatable relative to a threaded bore disposed in one end of said shaft to move said shaft coaxial of said longitudinal axis.

5. A compressor assembly of the type for compressing a recirculated refrigerant fluid, said assembly comprising;

a housing including a crank case and a head fixedly attached thereto;

a plurality of pistons disposed parallel relative to each other and supported for reciprocal movement in said housing;

a shaft having a longitudinal axis and centrally and nonrotatably supported in said crank case adjacent a key;

a wobble plate mounted about said shaft and a drive means rotatably driven about said longitudinal axis of said shaft for driving said wobble plate through angulatory movement relative to said shaft thereby reciprocating said pistons;

said assembly characterized by including a shaft adjustment means for nonrotatably moving said shaft coaxial of said longitudinal axis to predetermined points to adjust the position of said wobble plate, said shaft including a notch extending parallel to said longitudinal axis of said shaft, said key in abutting and sliding contact with said longitudinally extending notch in said shaft to prevent rotation thereof but allowing movement coaxial of said longitudinal axis of said shaft to adjust the position of said wobble plate thereby varying the displacement of said assembly.

* * * * *